US010836188B2

(12) United States Patent
Sue et al.

(10) Patent No.: US 10,836,188 B2
(45) Date of Patent: Nov. 17, 2020

(54) HEAD ASSEMBLY AND INKJET RECORDING APPARATUS

(71) Applicant: KYOCERA Document Solutions Inc., Osaka (JP)

(72) Inventors: Tomohiro Sue, Osaka (JP); Hiroyuki Tomioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/752,903

(22) Filed: Jan. 27, 2020

(65) Prior Publication Data

US 2020/0247155 A1 Aug. 6, 2020

(30) Foreign Application Priority Data

Jan. 31, 2019 (JP) ..... 2019-015557

(51) Int. Cl.
*B41J 25/00* (2006.01)

(52) U.S. Cl.
CPC ..... *B41J 25/001* (2013.01)

(58) Field of Classification Search
CPC .... B41J 25/001; B41J 25/003; B41J 2/16517; B41J 2/2146; B41J 2/16585
See application file for complete search history.

(56) References Cited

U.S. PATENT DOCUMENTS

2017/0232767 A1* 8/2017 Togashi ..... B41J 25/316 347/8
2018/0257393 A1* 9/2018 Sato ..... B41J 25/003
2018/0311983 A1* 11/2018 Saiga ..... B41J 25/316

FOREIGN PATENT DOCUMENTS

JP 2008-296518 A 12/2008

* cited by examiner

*Primary Examiner* — Kristal Feggins
(74) *Attorney, Agent, or Firm* — Studebaker & Brackett PC

(57) ABSTRACT

A head assembly includes a base member, a recording head, a first coupling member, a second coupling member, a first rotating shaft member, and a first angle adjustment mechanism. The first coupling member couples a first end of the recording heads to the base member. The second coupling member couples a second end of the recording head to the base member. The first rotating shaft member functions as a rotating shaft of the recording head. The first angle adjustment rotates the recording head about the first rotating shaft member as a rotation center. The first rotating shaft member is provided for the first coupling member. The first angle adjustment mechanism is provided for the second coupling member.

13 Claims, 13 Drawing Sheets

HEAD ASSEMBLY AND INKJET RECORDING APPARATUS

INCORPORATION BY REFERENCE

The present application claims priority under 35 U.S.C. § 119 to Japanese Patent Application No. 2019-015557, filed on Jan. 31, 2019. The contents of this application are incorporated herein by reference in their entirety.

BACKGROUND

The present disclosure relates to a head assembly and an inkjet recording apparatus.

A linehead type inkjet recording apparatus is one type of inkjet recording apparatus. The linehead type inkjet recording apparatus includes a recording head. The linehead type inkjet recording apparatus conveys a recording medium and ejects ink from the recording head toward the recording medium being conveyed, thereby recording an image on the recording medium. The recording head includes a nozzle surface in which multiple nozzle orifices that allow ink to be ejected therefrom are formed.

In general, the linehead type inkjet recording apparatus includes a head assembly including recording heads. The recording heads are arranged in a width direction of a recording medium. Here, the width direction is perpendicular to a conveyance direction of the recording medium. The linehead type inkjet recording apparatus is also configured to eject ink of the same color (one color) from each of the recording heads of the one head assembly. A linehead type inkjet recording apparatus for color printing therefore includes for example four head assemblies. Specifically, this inkjet recording apparatus includes a main body equipped with respective head assemblies for yellow, cyan, magenta, and black colors. The head assemblies for the different colors are arranged side by side in the conveyance direction of the recording medium.

What is needed in the linehead type inkjet recording apparatuses is a more accurate positioning of the recording heads. For example, the recording heads that eject ink of the same color need to be positioned so that respective angles of the recording heads are uniform in plan view. In other words, the recording heads that eject ink of the same color need to be arranged in parallel in a plane including the conveyance direction of the recording medium and the width direction of the recording medium. This is because the respective angles of the recording heads that eject ink of the same color not being uniform may reduce image quality. Specifically, image noise such as vertical stripe noise may occur.

SUMMARY

A head assembly according to an aspect of the present disclosure includes a base member, recording heads, coupling members, at least one first rotating shaft member, and at least one first angle adjustment mechanism. Each of the recording heads ejects ink. The coupling members couple the recording heads to the base member. The at least one first rotating shaft member serves as a rotating shaft of at least one recording head of the recording heads. The at least one first angle adjustment mechanism is configured to rotate the at least one recording head about the at least one first rotating shaft member as a rotation center. Each of the recording heads includes a first end and a second end on an opposite side from the first end. The coupling members include first coupling members and second coupling members. The first coupling members couple the respective first ends of the recording heads to the base member. The second coupling members couple the respective second ends of the recording heads to the base member. The at least one first rotating shaft member is provided for, of the first coupling members, at least one first coupling member corresponding to the at least one recording head. The at least one first angle adjustment mechanism is provided for, of the second coupling members, at least one second coupling member corresponding to the at least one recording head.

An inkjet recording apparatus according to an aspect of the present disclosure includes the above-described head assembly and an installation base on which the head assembly is installed.

DETAILED DESCRIPTION

Figure 1:
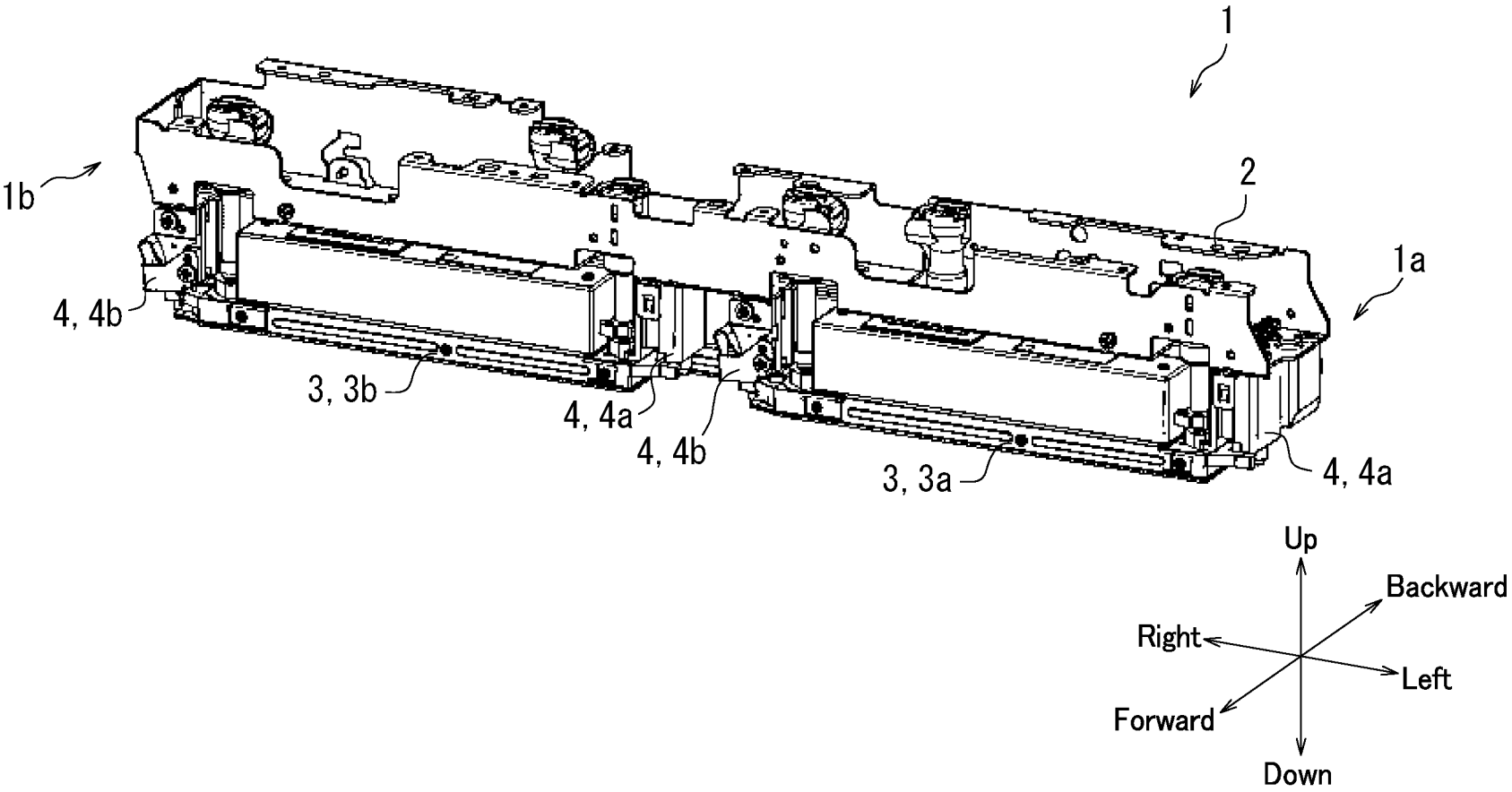
FIG. 1 is a perspective view of a head assembly according to an embodiment of the present disclosure.

Hereinafter, a head assembly according to an embodiment of the present disclosure will be described with FIGS. 1 to 7, and an inkjet recording apparatus according to an embodiment of the present disclosure will be described with reference to FIGS. 1 to 13. Elements that are the same or equivalent are indicated by the same reference signs in the drawings and description thereof is not repeated. In addition, overlapping description may be omitted as appropriate. Although a front-back direction, a vertical direction, and a left-right direction are described for easy understanding in the drawings, there is no intention to limit these directions as respective directions of a head assembly and an inkjet recording apparatus, when they are manufactured or used, according to an aspect of the present disclosure.

The head assembly 1 according to the present embodiment will first be described with reference to FIG. 1. FIG. 1 is a perspective view of the head assembly 1 according to the present embodiment. Specifically, FIG. 1 illustrates the head assembly 1 as seen diagonally from above front left. As illustrated in FIG. 1, the head assembly 1 includes a base member 2, recording heads 3, and coupling members 4.

The head assembly 1 is an elongated component and includes a first end 1*a* and a second end 1*b* on an opposite side from the first end 1*a*. The first end 1*a* is one end of the head assembly 1 in a longitudinal direction thereof, while the second end 1*b* is the other end of the head assembly 1 in the longitudinal direction. In the present embodiment, the first end 1*a* of the head assembly 1 is a left end thereof and the second end 1*b* of the head assembly 1 is a right end thereof.

The coupling members 4 couple the recording heads 3 to the base member 2. The base member 2 is an elongated member. In the present embodiment, the recording heads 3 include a first recording head 3*a* and a second recording head 3*b*. The head assembly 1 according to the present embodiment includes two coupling members 4 for each of the recording heads 3. The two coupling members 4 include a first coupling member 4*a* and a second coupling member 4*b*. The first coupling member 4*a* is located on the left of a corresponding one of the recording heads 3 to couple a left end of the corresponding recording head 3 to the base member 2. The second coupling member 4*b* is located on the right of the corresponding recording head 3 to couple a right end of the corresponding recording head 3 to the base member 2. In the present embodiment, a side of the base member 2 on which the recording heads 3 are mounted is a lower side of the base member 2, while the other side is an upper side thereof.

Figure 2:
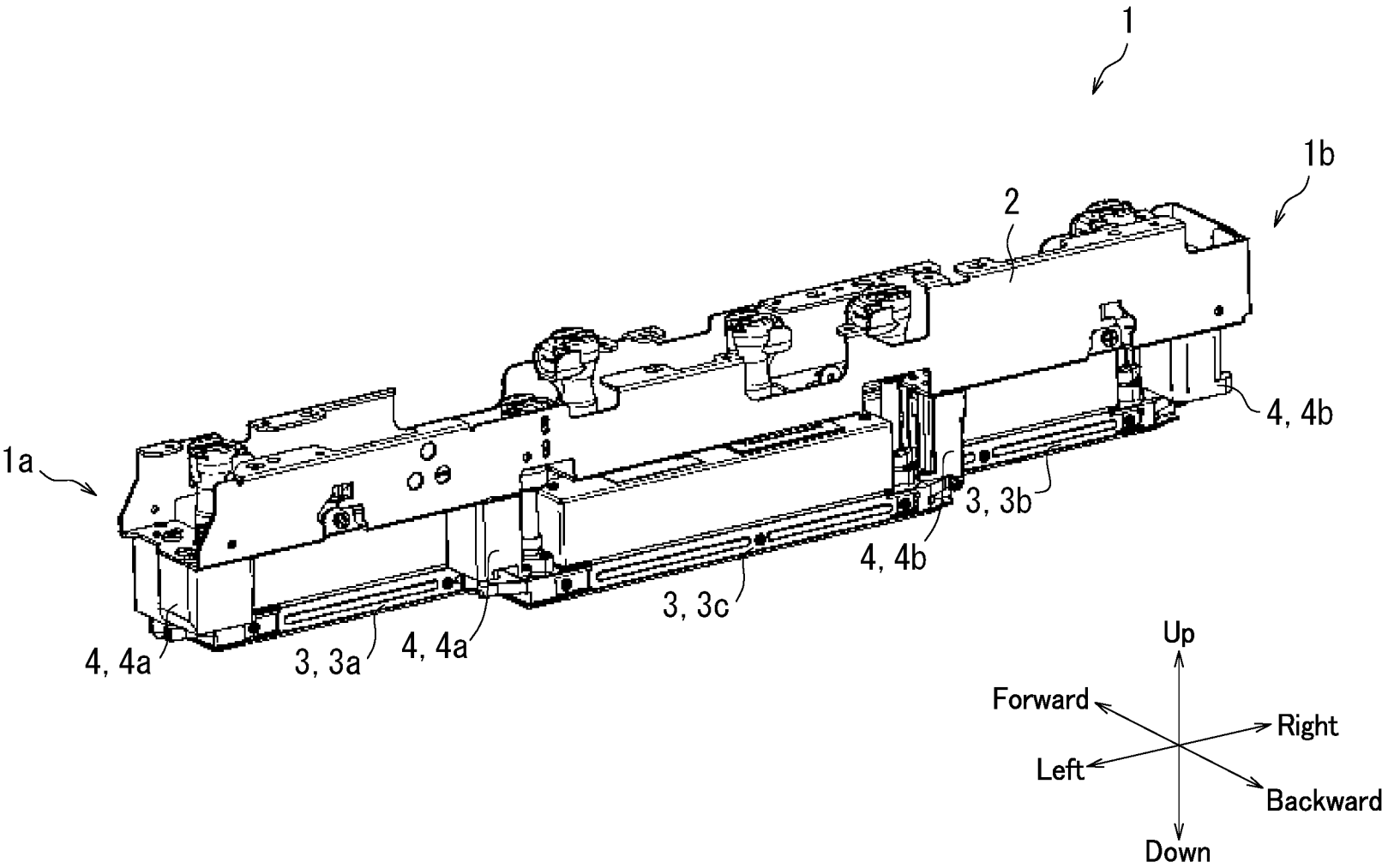
FIG. 2 is a perspective view of the head assembly according to the embodiment of the present disclosure.

The head assembly 1 according to the present embodiment will next be described with reference to FIG. 2. FIG. 2 is a perspective view of the head assembly 1 according to the present embodiment. Specifically, FIG. 2 illustrates the head assembly 1 as seen diagonally from above back left. As illustrated in FIG. 2, the recording heads 3 further include a third recording head 3*c*. That is, the head assembly 1 according to the present embodiment includes three recording heads 3.

In the present embodiment, the first recording head 3*a* is located at a side of the first end 1*a* of the head assembly 1. The second recording head 3*b* is located at a side of the second end 1*b* of the head assembly 1. The third recording head 3*c* is located at a center portion of the head assembly 1. The first to third recording heads 3*a* to 3*c* are mounted on the base member 2 in a staggered pattern in a longitudinal direction of the base member 2. Specifically, the third recording head 3*c* is set further back than the first and second recording heads 3*a* and 3*b*.

Figure 3:
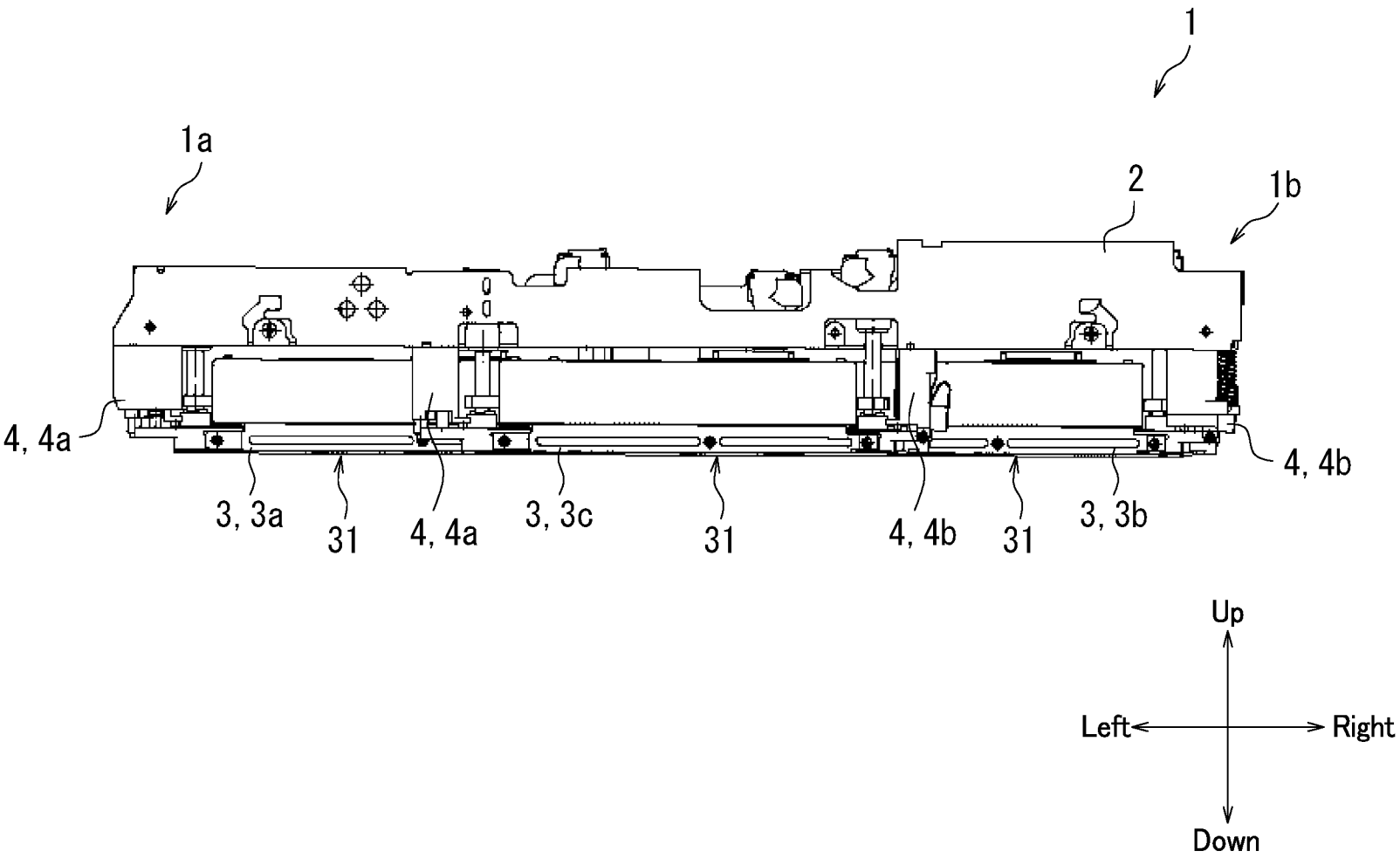
FIG. 3 is a perspective view of the head assembly according to the embodiment of the present disclosure.

The head assembly 1 according to the present embodiment will next be described with reference to FIG. 3. FIG. 3 is a rear view of the head assembly 1 according to the present embodiment. As illustrated in FIG. 3, the present embodiment includes three recording heads 3, each of which includes a nozzle surface 31. Ink is ejected from each of the nozzle surfaces 31 of the recording heads 3. Specifically, multiple nozzle orifices are formed in each of the nozzle surfaces 31 and ink is ejected from each of the nozzle orifices. Each nozzle surface 31 forms at least part of a lower surface (bottom surface) of a corresponding one of the recording heads 3. Note that the first to third recording heads 3*a* to 3*c* eject ink of the same color.

Figure 4:
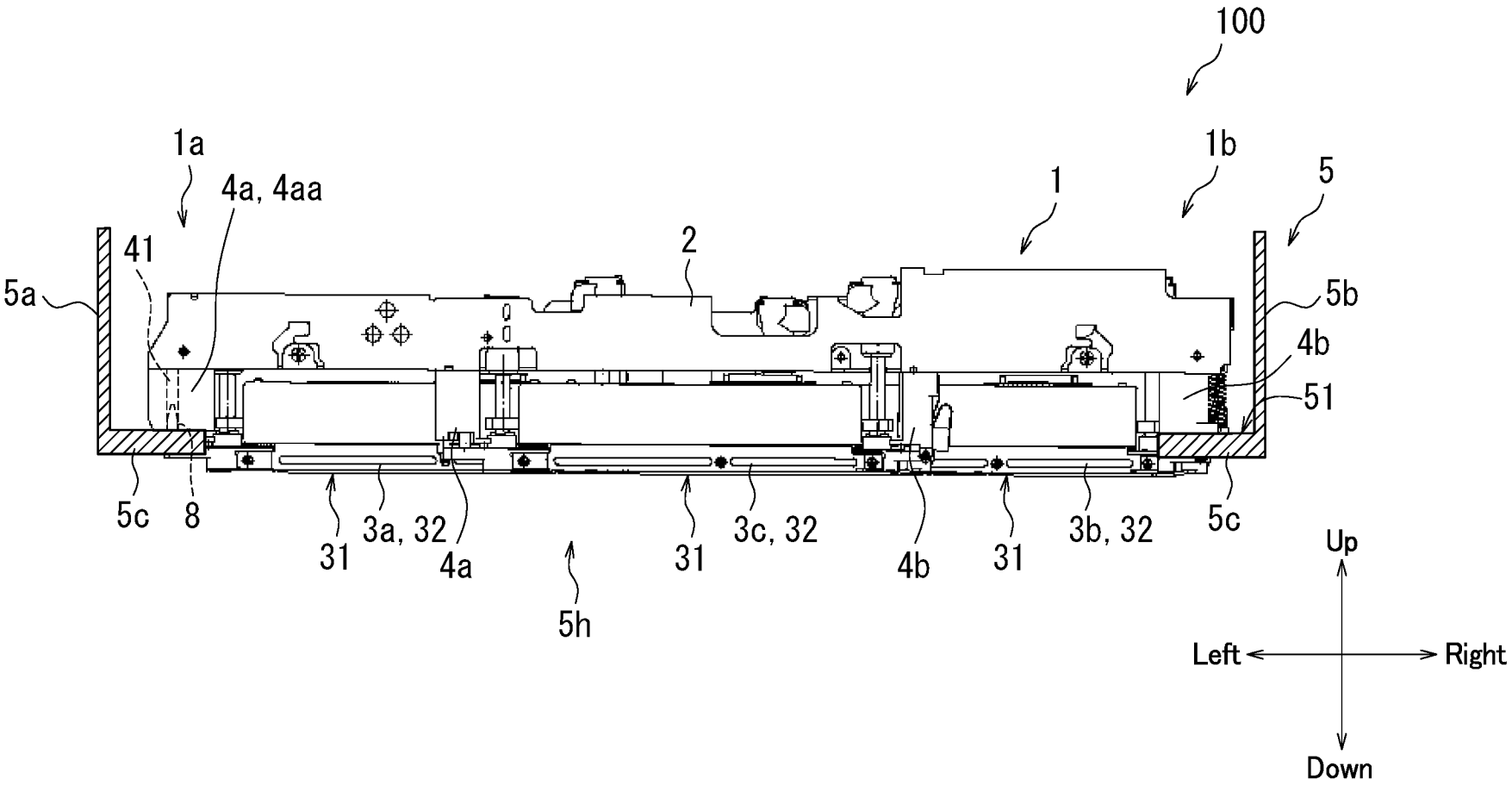
FIG. 4 is a perspective view of an inkjet recording apparatus according to the embodiment of the present disclosure.

The inkjet recording apparatus 100 according to the present embodiment will next be described with reference to FIG. 4. FIG. 4 illustrates the inkjet recording apparatus 100 according to the present embodiment. As illustrated in FIG. 4, the inkjet recording apparatus 100 includes the head assembly 1, an installation base 5, and a positioning member 8.

The head assembly 1 is installed in the installation base 5. The installation base 5 includes for example a frame body with an opening formed in an upper surface thereof. In this case, the installation base 5 houses the head assembly 1. The installation base 5 is supported by a body frame provided for the inkjet recording apparatus 100.

The installation base 5 includes a first side wall 5*a*, a second side wall 5*b*, and a bottom wall 5*c*. In the present embodiment, the first side wall 5*a* is a left side wall of the installation base 5 and the second side wall 5*b* is a right side wall thereof. The first side wall 5*a* is connected to a left end of the bottom wall 5*c* and extends upward from the bottom wall 5*c*. The second side wall 5*b* is connected to a right end of the bottom wall 5*c* and extends upward from the bottom wall 5*c*.

The bottom wall 5*b* includes an opening 5*h* and a loading surface 51. The head assembly 1 is installed in the installation base 5 with part of a lower surface of the head assembly 1 mounted on the loading surface 51. When the head assembly 1 is installed in the installation base 5, respective lower ends 32 (ends on each nozzle surface side) of the first to third recording heads 3*a* to 3*c* protrude from the opening 5*h*. The respective nozzle surfaces 31 of the first to third recording heads 3*a* to 3*c* are consequently positioned below the bottom wall 5*c* of the installation base 5.

The positioning member 8 is provided in the installation base 5, and determines the position of the head assembly 1 installed in the installation base 5. Specifically, the positioning member 8 determines the position of the head assembly 1 in a longitudinal direction thereof. In the present embodiment, the positioning member 8 is a pin-shaped member and provided on the bottom wall 5*c* of the installation base 5. Specifically, the positioning member 8 extends upward from the loading surface 51. The positioning member 8 is located at a side of a first end 1*a* of the head assembly 1. An insertion hole 41 is formed in a first coupling member 4*a* located at the side of the first end 1*a* of the head assembly 1. The positioning member 8 is inserted into the insertion hole 41, thereby determining the position of the head assembly 1. In the present embodiment, the insertion hole 41 is a through hole. Note that in the description below, the first coupling member 4*a* located at the side of the first end 1*a* of the head assembly 1 may be referred to as a "first coupling member 4*aa*".

Figure 5:
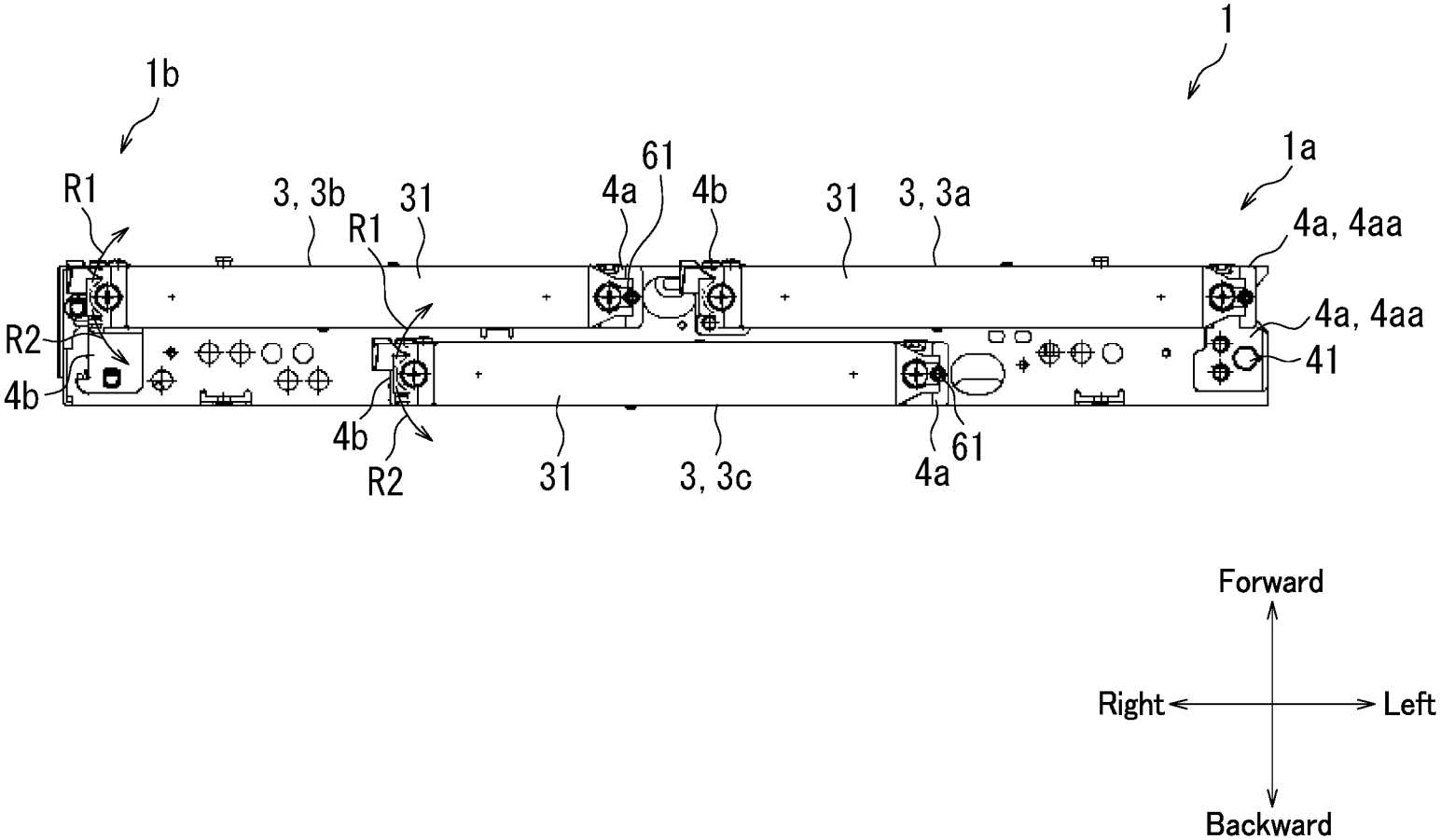
FIG. 5 is a perspective view of the head assembly according to the embodiment of the present disclosure.

The head assembly 1 according to the present embodiment will next be described with reference to FIG. 5. FIG. 5 is a bottom view of the head assembly 1 according to the present embodiment. Each recording head 3 is elongated in a left-right direction as illustrated in FIG. 5. In other words, each recording head 3 is elongated in the longitudinal direction of the head assembly 1.

As illustrated in FIG. 5, the head assembly 1 according to the present embodiment includes two rotating shaft members 61. One of the two rotating shaft members 61 is a rotating shaft of a second recording head 3*b*. The other of the two rotating shaft members 61 is a rotating shaft of a third recording head 3*c*. The second and third recording heads 3*b* and 3*c* are rotatable about the respective rotating shaft members 61 as respective rotation centers in rotation directions R1 and R2. The rotation direction R2 is a rotation direction opposite to the rotation direction R1. The rotating shaft members 61 are provided for respective corresponding first coupling members 4*a*. Specifically, the rotating shaft members 61 in the present embodiment are provided for first coupling members 4*a* except the first coupling member 4*aa*.

Figure 6:
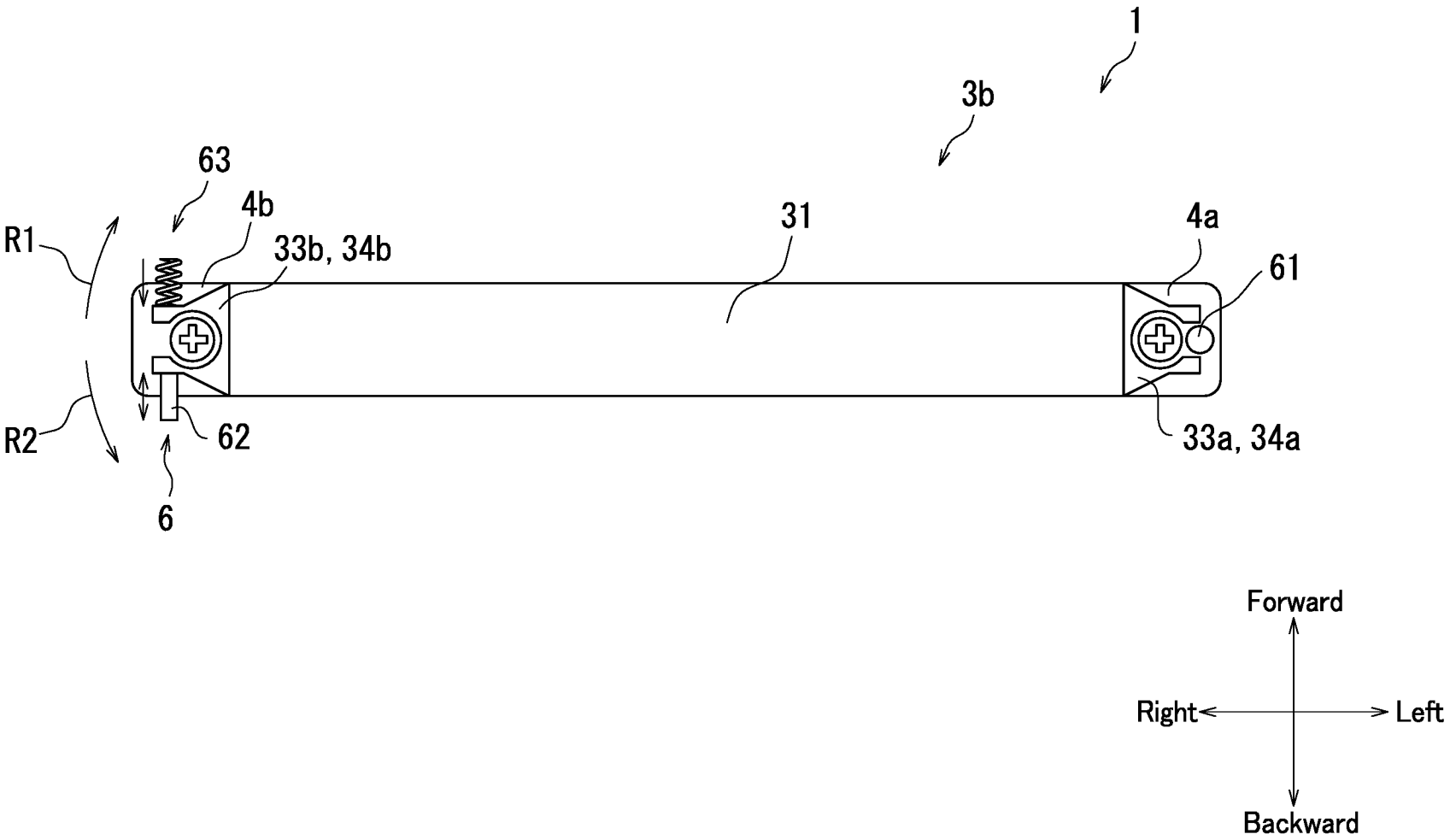
FIG. 6 is a bottom view depicting a second recording head and a first angle adjustment mechanism in the embodiment of the present disclosure.

The rotating shaft members 61 and angle adjustment mechanisms 6 according to the present embodiment will next be described with reference to FIG. 6. FIG. 6 is a bottom view depicting the second recording head 3*b* and a first angle adjustment mechanism 6 according to the present embodiment.

As shown in FIG. 6, the second recording head 3*b* includes a first end 33*a* and a second end 33*b* on an opposite side from the first end 33*a*. The first end 33*a* is a left end of the second recording head 3*b*, and the second end 33*b* is a right end of the second recording head 3*b*. Note that each of first and third recording heads 3*a* and 3*c* includes first and second ends 33*a* and 33*b* like the second recording head 3*b*. As described with reference to FIGS. 1 and 2, three first coupling members 4*a* couple respective first ends 33*a* of first to third recording heads 3*a* to 3*c* to a base member 2. Similarly, as described with reference to FIGS. 1 and 2, three second coupling members 4*b* couple respective second ends 33*b* of the first to third recording heads 3*a* to 3*c* to the base member 2.

As illustrated in FIG. 6, the head assembly 1 further includes the first angle adjustment mechanism 6. The first angle adjustment mechanism 6 is provided for a corresponding second coupling member 4*b*. The first angle adjustment mechanism 6 rotates the second recording head 3*b* about the rotating shaft member 61 as a rotation center, thereby adjusting an angle of the second recording head 3*b* relative to the longitudinal direction of the head assembly 1. Specifically, a worker operates the first angle adjustment mechanism 6 to rotate the second recording head 3*b* in a rotation direction R1 or a rotation direction R2. Note that the head assembly 1 includes a first angle adjustment mechanism 6 provided for the third recording head 3*c* in addition to the first angle adjustment mechanism 6 provided for the second recording head 3*b*.

The head assemblies 1 according to the present embodiment have been described above with reference to FIGS. 1 and 6. Returning to FIG. 6, the embodiment enables the worker to rotate the second recording head 3*b* in the rotation direction R1 or the rotation direction R2 by operating the first angle adjustment mechanism 6 provided for the second recording head 3*b*. Similarly, the embodiment enables the worker to rotate the third recording head 3*c* in the rotation direction R1 or the rotation direction R2 by operating the first angle adjustment mechanism 6 provided for the third recording head 3*c*. It is therefore possible to facilitate adjustment of respective angles of the second and third recording heads 3*b* and 3*c*. The configuration allows the respective angles of the second and third recording heads 3*b* and 3*c* to be adjusted so that the second and third recording heads 3*b* and 3*c* are parallel to the first recording head 3*a*. The adjustment of the respective angles of the second and third recording heads 3*b* and 3*c* is performed for example when the head assembly 1 is assembled.

Next, the head assembly 1 according to the present embodiment will further be described with reference to FIG. 6. As illustrated in FIG. 6, the first end 33*a* of the second recording head 3*b* includes a first extension part 34*a*, and the second end 33*b* of the second recording head 3*b* includes a second extension part 34*b*. The first and second extension parts 34*a* and 34*b* are located outside a nozzle surface 31 of the second recording head 3*b*. Specifically, the first extension part 34*a* is placed on the left of the nozzle surface 31. The second extension part 34*b* is located on the right of the nozzle surface 31. The rotating shaft member 61 is provided for the first coupling member 4*a* and supports the first extension part 34*a* of the second recording head 3*b* in a rotatable manner.

Note that the third recording head 3*c* includes first and second extension parts 34*a* and 34*b* like the second recording head 3*b*. A rotating shaft member 61 of the third recording head 3*c* is provide for the first coupling member 4*a* thereof and supports a first extension part 34*a* of the third recording head 3*c* in a rotatable manner like the rotating shaft member 61 of the second recording head 3*b*.

As illustrated in FIG. 6, the first angle adjustment mechanism 6 includes a pressing member 62 and an urging member 63. The pressing member 62 and the urging member 63 are provided for the second coupling member 4*b*. The pressing member 62 is in contact with the second end 33*b* of the second recording head 3*b*. The urging member 63 urges the second end 33*b* of the second recording head 3*b* in the rotation direction R2. This enables the worker to rotate the second recording head 3*b* in the rotation direction R1 or the rotation direction R2 by adjusting a position of the pressing member 62. In the present embodiment, the pressing member 62 is in contact with the second extension part 34*b* of the second recording head 3*b*, and the urging member 63 urges the second extension part 34*b* of the second recording head 3*b*.

Figure 7:
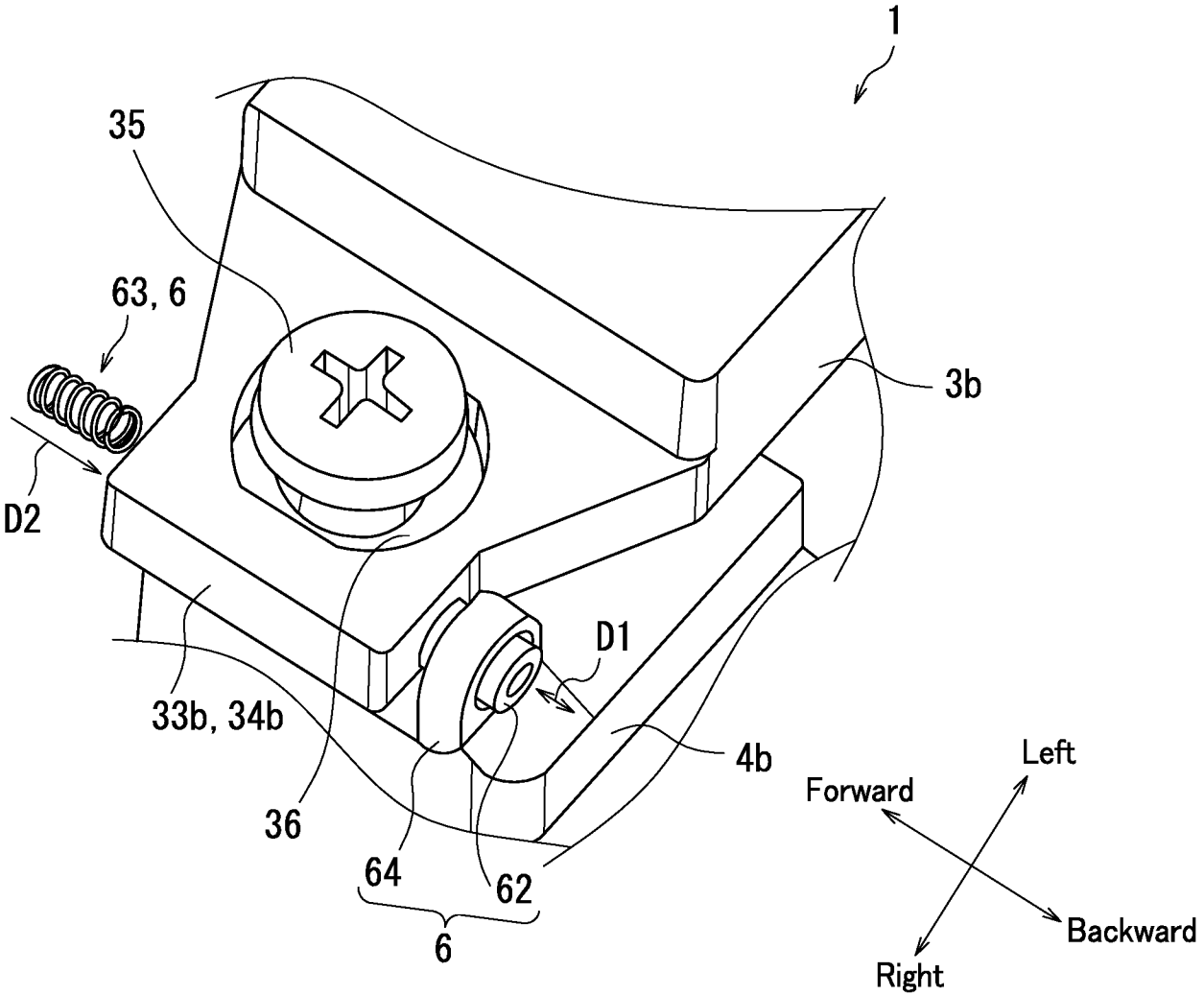
FIG. 7 is an enlarged perspective view of the second recording head and the first angle adjustment mechanism in the embodiment of the present disclosure.

Next, the second recording heads 3*b* and the first angle adjustment mechanism 6 according to the present embodiment will further be described with reference to FIG. 7. FIG. 7 is an enlarged perspective view of the second recording head 3*b* and the first angle adjustment mechanism 6 thereof according to the present embodiment.

As illustrated in FIG. 7, the head assembly 1 includes fastening members 35. The second recording head 3*b* includes a hole 36 formed in the second extension part 34*b*. A fastening member 35 is fastened to the second coupling member 4*b* through the hole 36 in the second extension part 34*b*. The hole 36 in the second extension part 34*b* has a diameter larger than a diameter of a shaft of the fastening member 35.

As illustrated in FIG. 7, the first angle adjustment mechanism 6 includes a support part 64 in addition to the pressing member 62 and the urging member 63. The support part 64 is provided for the second coupling member 4*b* and supports the pressing member 62. Specifically, the support part 64 supports the pressing member 62 so that the pressing member 62 is in contact with a back side face of the second extension part 34*b*. That is, the support part 64 supports the pressing member 62 and allows the pressing member 62 to be moved relative to the support part 64 in a movement direction D1 illustrated in FIG. 7. A protrusion length of the pressing member 62 from the support part 64 varies according to movement of the pressing member 62 in the movement direction D1. Here, the protrusion length represents the length of the pressing member 62 protruding from the support part 64 toward the second extension part 34*b*.

Specifically, the support part 64 includes a through hole extending in the movement direction D1. The through hole is a tapped hole, and the pressing member 62 is inserted into the through hole. A thread groove is formed in a surface of the pressing member 62, and the pressing member 62 is screwed into the through hole of the support part 64. This enables the worker to move the pressing member 62 in the movement direction D1 by rotating the pressing member 62. In other words, the embodiment enables the worker to change a protrusion length of the pressing member 62 from the support part 64 by rotating the pressing member 62. When the protrusion length of the pressing member 62 from the support part 64 is increased, the pressing member 62 pushes the second extension part 34*b*, thereby moving the second extension part 34*b*. The second recording head 3*b* consequently rotates in the rotation direction R1 described with reference to FIG. 6. The pressing member 62 is for example a set or grub screw.

The urging member 63 is in contact with a front side face of the second extension part 34*b* and urges the second extension part 34*b* in an urging direction D2 illustrated in FIG. 7. Therefore, when the protrusion length of the pressing member 62 from the support part 64 is decreased, the second extension part 34*b* moves by urging force of the urging member 63 following the movement of the pressing member 62. The second recording head 3*b* consequently rotates in the rotation direction R2 described with reference to FIG. 6. The urging member 63 is for example a spring member.

The present embodiment enables the worker to rotate the second recording head 3*b* by moving the pressing member 62 in the movement direction D1 as described above with reference to FIGS. 6 and 7. It is therefore possible to facilitate adjustment of the angle of the second recording head 3*b*.

Note that the first angle adjustment mechanism 6 provided for the third recording head 3*c* has a configuration similar to that of the first angle adjustment mechanism 6 provided for the second recording head 3*b*. In the present embodiment, it is therefore possible to facilitate adjustment of an angle of the third recording head 3*c*.

Figure 8:
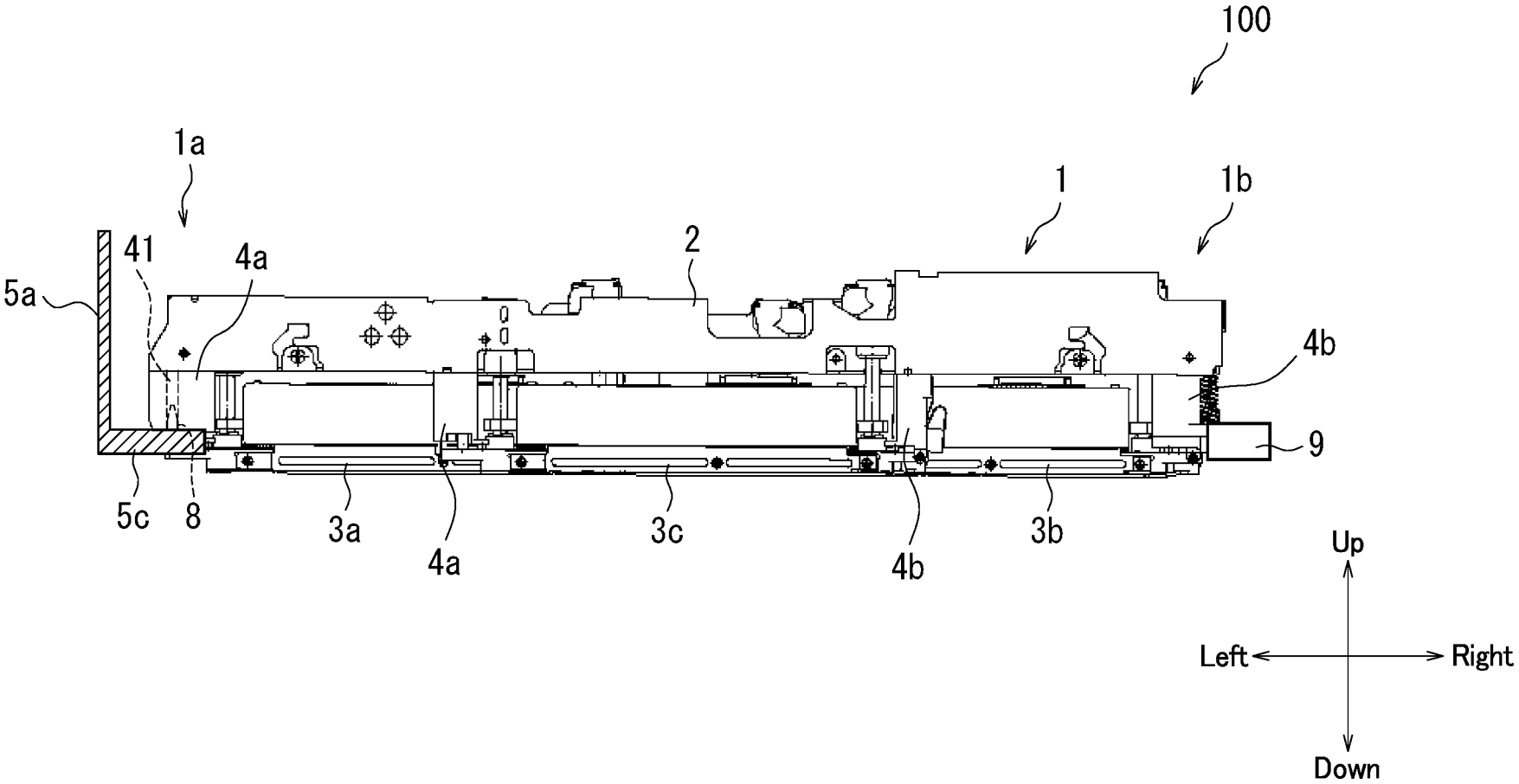
FIG. 8 illustrates the inkjet recording apparatus according to the embodiment of the present disclosure.
Figure 9:
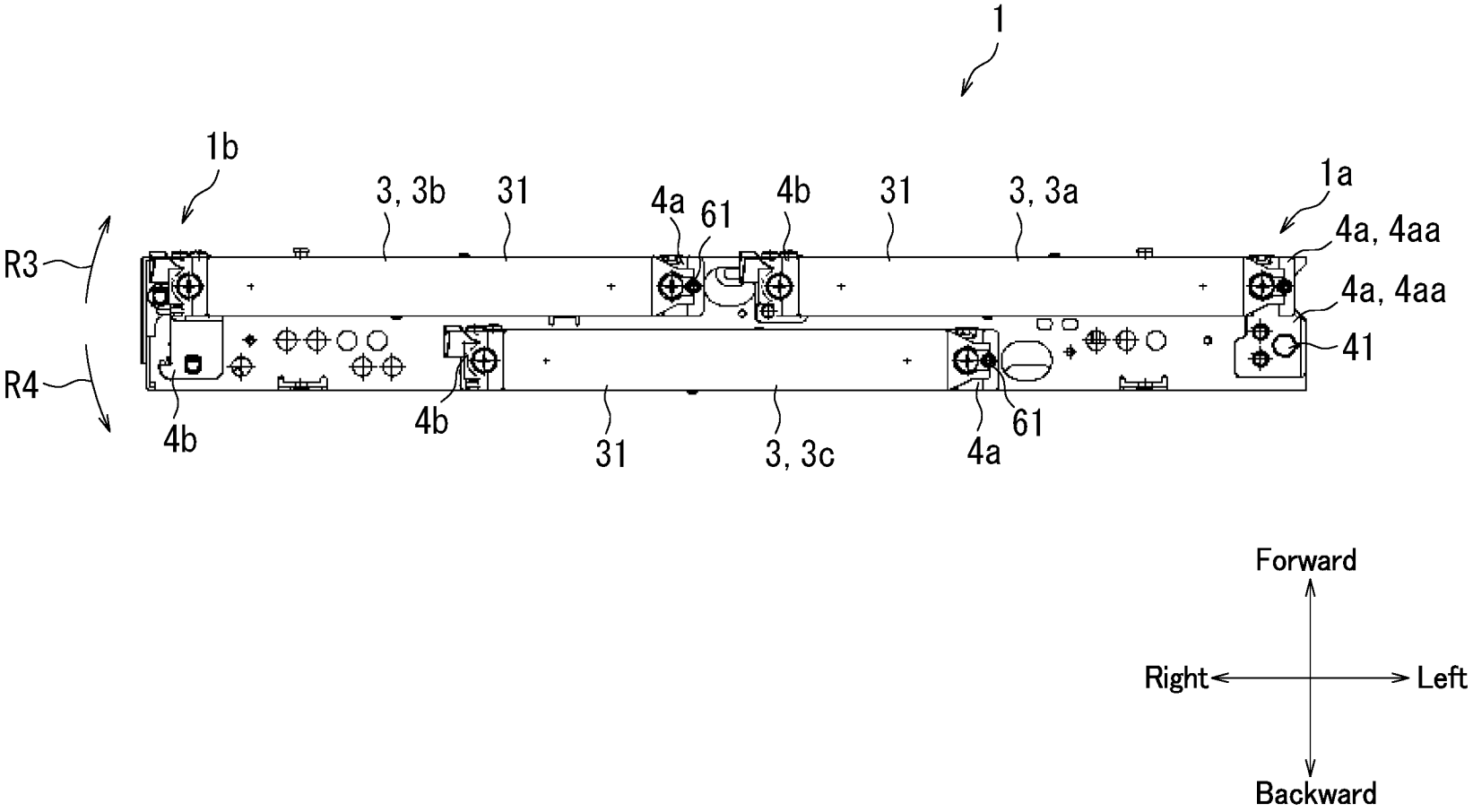
FIG. 9 is a bottom view of the head assembly according to the embodiment of the present disclosure.

An inkjet recording apparatus 100 according to an embodiment will next be described with reference to FIGS. 8 and 9. FIG. 8 illustrates the inkjet recording apparatus 100 according to the present embodiment. Note that a part of the bottom wall 5*c* and the second side wall 5*b* described with reference to FIG. 4 are omitted in FIG. 8 in order to simplify the drawing. FIG. 9 is a bottom view of a head assembly 1 according to the present embodiment. Specifically, FIG. 9 illustrates a rotation direction R3 and a rotation direction R4 of the head assembly 1. The rotation direction R4 is a rotation direction opposite to the rotation direction R3.

As illustrated in FIG. 8, the inkjet recording apparatus 100 further includes a second angle adjustment mechanism 9. The second angle adjustment mechanism 9 rotates the head assembly 1 about a positioning member 8 as a rotation center. That is, in the present embodiment, the positioning member 8 functions as a rotating shaft for the head assembly 1. In other words, the positioning member 8 functions as a rotating shaft member. The second angle adjustment mechanism 9 is provided for an installation base 5 as described with reference to FIG. 4. Specifically, the second angle adjustment mechanism 9 is located at a side of a second end 1*b* of the head assembly 1.

Specifically, the second angle adjustment mechanism 9 (FIG. 8) is used for rotating the head assembly 1 about the positioning member 8 (insertion hole 41) as the rotation center in the rotation direction R3 or the rotation direction R4 as illustrated in FIG. 9. An angle of the head assembly 1 is accordingly adjusted relative to the installation base 5. In the present embodiment, the angle of the head assembly 1 relative to the left-right direction is adjusted.

The inkjet recording apparatus 100 according to the present embodiment has been described above with reference to FIGS. 8 and 9. The embodiment enables a worker to adjust the angle of the head assembly 1 by operating the second angle adjustment mechanism 9. Specifically, the inkjet recording apparatus 100 includes four head assemblies 1 (first head assembly 11, second head assembly 12, third head assembly 13, and fourth head assembly) to be described with reference to FIG. 13. The inkjet recording apparatus 100 includes respective second angle adjustment mechanisms 9 provided for the four head assemblies 1. The present embodiment enables arrangement of the four head assemblies 1 in parallel by adjusting respective angles of the four head assemblies 1. The angle adjustment of the head assemblies 1 is performed after the head assemblies 1 are installed in the installation base 5.

Next, the head assemblies 1 according to the present embodiment will further be described with reference to FIGS. 5 and 9. First to third recording heads 3*a* to 3*c* in the embodiment include respective first ends 33*a* (left ends) and second ends 33*b* (right ends) as described with reference to FIG. 6. As illustrated in FIGS. 5 and 9, the first end 33*a* (an end on a side of first coupling member 4*a*) of the first recording head 3*a* is located at a side of a first end 1*a* of the head assembly 1. The second end 33*a* (an end on s side of second coupling member 4*b*) of the first recording head 3*a* is located at a side of a second end 1*b* of the head assembly 1. In other words, the first recording head 3*a* is positioned such that the first end 33*a* of the first recording head 3*a* is closer to the first end 1*a* of the head assembly 1 than the second end 33*b* of the first recording head 3*a*. The second and third recording heads 3*b* and 3*c* are arranged like the first recording head 3*a*. Therefore, the rotating shaft members 61 of the second recording heads 3*b* is positioned closer to the first end 1*a* of the head assembly 1 than the second end 33*b* of the second recording head 3*b*. Similarly, the rotating shaft members 61 of the third recording head 3*c* is positioned closer to the first end 1*a* of the head assembly 1 than the second end 33*b* of the third recording head 3*c*. A rotating shaft member (positioning member 8) of the head assembly 1 is located at a side of the first end 1*a* of the head assembly 1. Therefore, respective rotating shafts of the second and third recording heads 3*b* and 3*c* and the head assembly 1 are located at the same side. This facilitates angle adjustment of the recording heads 3 and the head assembly 1.

Figure 10:
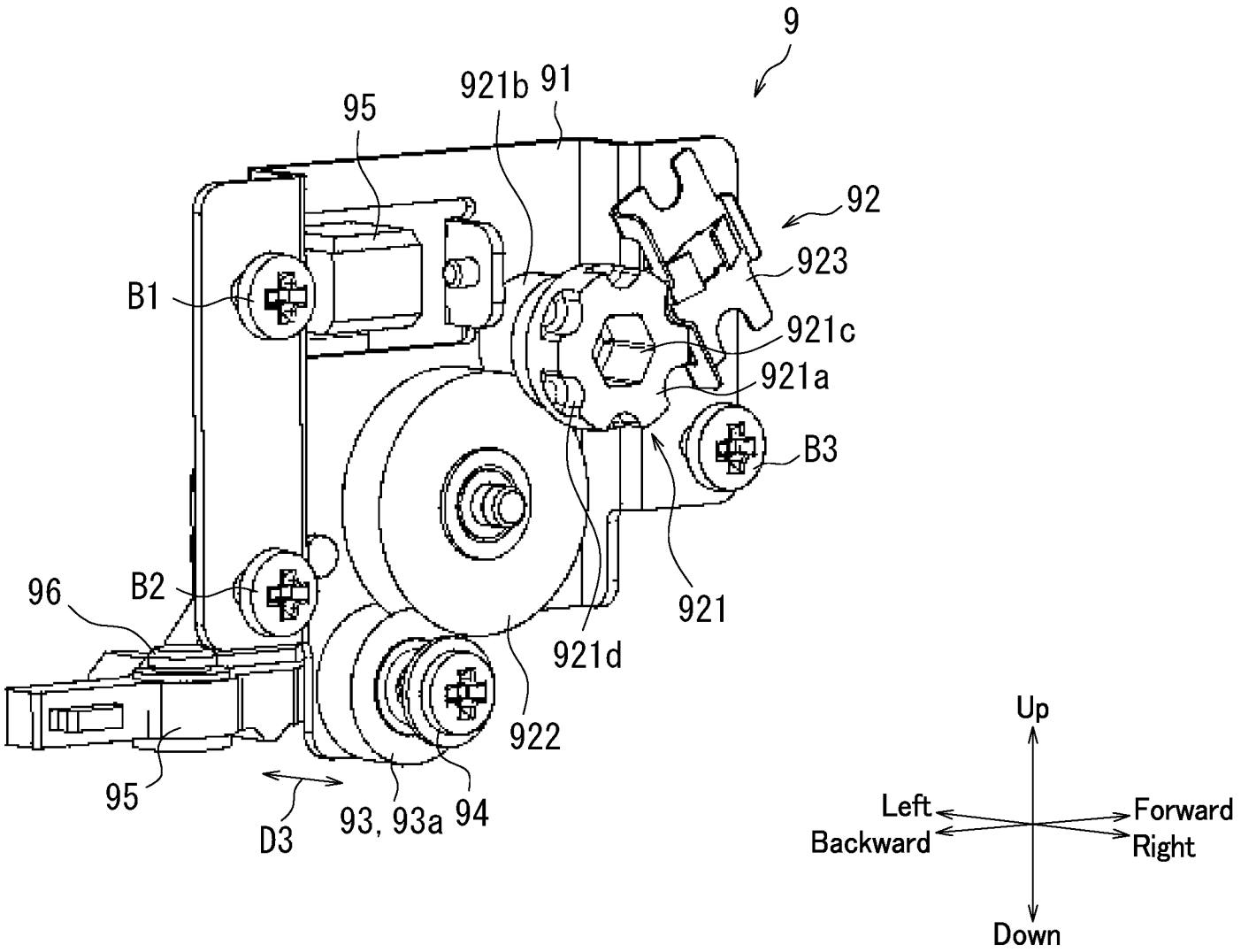
FIG. 10 is a perspective view of the second angle adjustment mechanism in the embodiment of the present disclosure.

Next, the second angle adjustment mechanisms 9 in the present embodiment will further be described with reference to FIGS. 10 to 12. FIG. 10 is a perspective view of the second angle adjustment mechanism 9 in the present embodiment. Specifically, FIG. 10 illustrates the second angle adjustment mechanism 9 as seen diagonally from back right.

As illustrated in FIG. 10, the second angle adjustment mechanism 9 includes an attachment plate 91, a coupling mechanism 92, a pressing member 93, a rotating shaft member 94, an angle adjustment member 95, and a rotating shaft member 96. The second angle adjustment mechanism 9 further includes three fastening members B1 to B3.

The coupling mechanism 92 and the pressing member 93 are attached to the attachment plate 91. The attachment plate 91 is fixed to the second side wall 5*b* described with reference to FIG. 4 with the three fastening members B1 to B3.

The rotating shaft member 94 supports the pressing member 93 in a movable manner in a movement direction D3 illustrated in FIG. 10. The coupling mechanism 92 is coupled to the pressing member 93. The coupling mechanism 92 is operated by the worker. The coupling mechanism 92 moves the pressing member 93 in the movement direction D3 according to the worker operation. The angle adjustment member 95 rotates about the rotating shaft member 96 as a rotation center according to movement of the pressing member 93 in the movement direction D3 as described with reference to FIG. 11.

In the present embodiment, the coupling mechanism 92 includes an operation member 921 that is operable by the worker. The coupling mechanism 92 moves the pressing member 93 in the movement direction D3 according to the worker operation of the operation member 921. Specifically, the coupling mechanism 92 in the present embodiment includes an idler gear 922 in addition to the operation member 921.

The operation member 921 is attached to the attachment plate 91 in a rotatable manner. The operation member 921 includes an operation part 921*a*, a gear part 921*b*, and an operation hole 921*c*. This configuration enables the worker to rotate the operation member 921 with for example a hex wrench fit into the operation hole 921*c*. The gear part 921*b* has a tooth part. The tooth part is located on a peripheral surface of the gear part 921*b*. Specifically, the tooth part of the gear part 921*b* includes teeth arranged around the gear part 921*b* in a peripheral direction thereof. The pressing member 93 is supported by the rotating shaft member 94 in a rotatable manner. In other words, the pressing member 93 is rotatable about the rotating shaft member 94 as a rotation center. The pressing member 93 includes a gear part 93*a*. The gear part 93*a* has a tooth part. The tooth part is located on a peripheral surface of the gear part 93*a*. Specifically, the tooth part of the gear part 93*a* includes teeth arranged around the gear part 93*a* in a peripheral direction thereof.

The idler gear 922 is attached to the attachment plate 91 in a rotatable manner. The idler gear 922 has a tooth part. The tooth part is located on a peripheral surface of the idler gear 922. Specifically, the tooth part of the idler gear 922 includes teeth arranged around the idler gear 922 in a peripheral direction thereof. The idler gear 922 is positioned so that the tooth part of the idler gear 922 engages with the tooth part of the operation member 921 (gear part 921*b*) and tooth part of the pressing member 93 (gear part 93*a*). This enables the pressing member 93 to rotate according to rotation of the operation member 921.

The pressing member 93 includes a through hole. The through hole is a tapped hole and the rotating shaft member 94 is inserted into the through hole. Specifically, a thread groove is formed in a surface of a shaft of the rotating shaft member 94 and the shaft of the rotating shaft member 94 is screwed into the through hole of the pressing member 93. This enables the pressing member 93 to move in the movement direction D3 according to rotation of the idler gear 922.

In the present embodiment, the coupling mechanism 92 further includes a click part 923. The operation member 921 includes recesses 921*d*. The recesses 921*d* are located on a peripheral surface of the operation part 921*a*. Specifically, the recesses 921*d* are arranged around the operation part 921*a* in a peripheral direction thereof.

The click part 923 sequentially engages with each of the recesses 921*d* of the operation member 921 according to the rotation of the operation member 921. This enables the worker to obtain clicking sensation from the click part 923 by operating the operation member 921. Thus, the worker can recognize a change in the angle of the head assembly 1 based on the clicking sensation during the angle adjustment of the head assembly 1. The click part 923 is produced by processing for example a leaf spring.

Next, the second angle adjustment mechanism 9 and the head assembly 1 will further be described with reference to FIG. 11. FIG. 11 is a bottom view depicting the second angle adjustment mechanism 9 and the second coupling member 4*b* in the present embodiment. Specifically, FIG. 11 illustrates the second coupling member 4*b* located at the side of the second end 1*b* of the head assembly 1. In the description below, the second coupling member 4*b* located at the side of the second end 1*b* of the head assembly 1 may be referred to as a "second coupling member 4*bb*".

Figure 11:
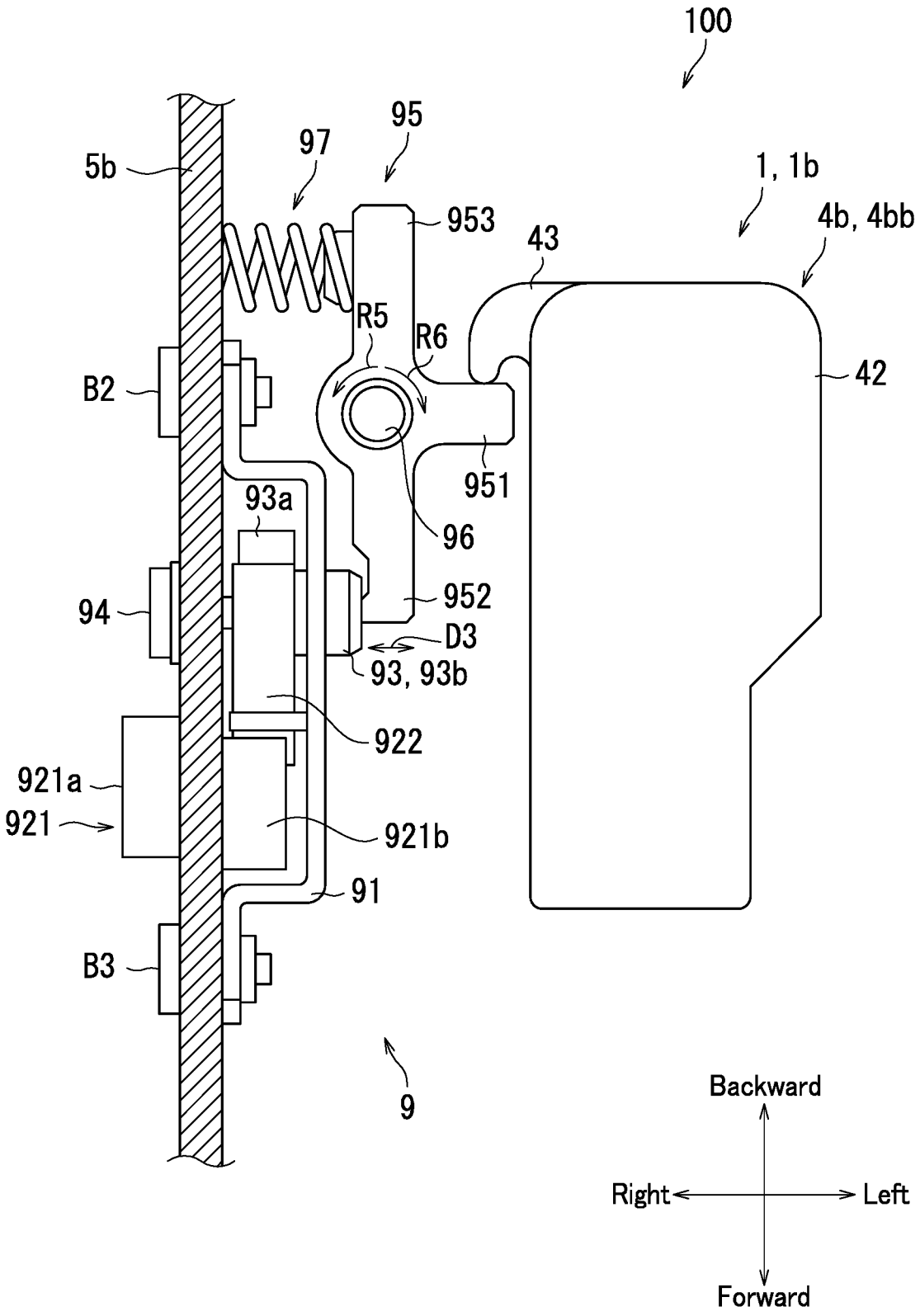
FIG. 11 is a bottom view depicting the second angle adjustment mechanism and the second coupling member in the embodiment of the present disclosure.

As illustrated in FIG. 11, the angle adjustment member 95 is placed inside the second side wall 5*b*. The pressing member 95 is rotatable about the rotating shaft member 96 as the rotation center. Specifically, the angle adjustment member 95 is rotatable in a rotation direction R5 and a rotation direction R6 illustrated in FIG. 11. The rotation direction R6 is a rotation direction opposite to the rotation direction R5.

The angle adjustment member 95 includes a first engagement part 951 that engages with the head assembly 1. In the present embodiment, the first engagement part 951 is a protrusion piece that protrudes in a direction perpendicular to a direction in which the rotating shaft member 96 extends. Specifically, the first engagement part 951 protrudes in a radial direction from a center part (rotating shaft member 96) of the angle adjustment member 95. That is, the first engagement part 951 extends toward a lower end 42 of the second coupling member 4*bb*.

The head assembly 1 includes a head engagement part 43 that engages with the first engagement part 951. In the present embodiment, the head engagement part 43 is a protrusion piece that is in contact with the first engagement part 951 and that protrudes from the lower end 42 of the second coupling member 4*bb*. In other words, the lower end 42 of the second coupling member 4*bb* includes the head engagement part 43.

In the arrangement, the first engagement part 951 pushes the head engagement part 43 according to rotation of the angle adjustment member 95 about the rotating shaft member 96 as the rotation center in the rotation direction R5. The head assembly 1 rotates about the positioning member 8 (insertion hole 41) as the rotation center in the rotation direction R4 according to the first engagement part 951 pushing the head engagement part 43 as described with reference to FIGS. 8 and 9.

As illustrated in FIG. 11, the angle adjustment member 95 further includes a second engagement part 952 that engages with the pressing member 93. In the present embodiment, the second engagement part 952 is a protrusion piece that protrudes in a direction perpendicular to a direction in which the rotating shaft member 96 extends. Specifically, the second engagement part 952 protrudes in a radial direction from the center part (rotating shaft member 96) of the angle adjustment member 95. Specifically, the second engagement part 952 protrudes in a direction different from a direction in which the first engagement part 951 protrudes.

The pressing member 93 includes a contact part 93*b*. The contact part 93*b* is in contact with the angle adjustment member 95. Specifically, the contact part 93*b* is in contact with the second engagement part 952. The contact part 93*b* pushes the second engagement part 952 according to movement of the pressing member 93 in the movement direction D3, thereby rotating the angle adjustment member 95 in the rotation direction R5. The head assembly 1 accordingly rotates about the positioning member 8 (insertion hole 41) as the rotation center in the rotation direction R4 as described with reference to FIGS. 8 and 9. In other words, the head assembly 1 rotates in the rotation direction R4 according to the worker operation of the operation member 921. This enables the worker to adjust the angle of the head assembly 1 by operating the operation member 921.

Specifically, the contact part 93*b* penetrates the attachment plate 91. A protrusion length of the contact part 93*b* from the attachment plate 91 varies according to movement of the pressing member 93 in the movement direction D3. Here, the protrusion length is length of the contact part 93*b* protruding from the attachment plate 91 toward the second engagement part 952. This enables the worker to vary the protrusion length of the contact part 93*b* from the attachment plate 91 by rotating the operation member 921. When the protrusion length of the contact part 93*b* from the attachment plate 91 is increased, the angle adjustment member 95 rotates in the rotation direction R5 according to the contact part 93*b* pushing the second engagement part 952. The head assembly 1 accordingly rotates about the positioning member 8 as the rotation center in the rotation direction R4.

As illustrated in FIG. 11, the second angle adjustment mechanism 9 includes an urging member 97. The urging member 97 urges the angle adjustment member 95 so that the angle adjustment member 95 rotates in the rotation direction R6. The urging member 97 is for example a spring member.

Specifically, the angle adjustment member 95 includes a third engagement part 953 that engages with the urging member 97. In the present embodiment, the third engagement part 953 is a protrusion piece that extends in a direction perpendicular to a direction in which the rotating shaft member 96 extends. Specifically, the third engagement part 953 protrudes in a radial direction from the center part (rotating shaft member 96) of the angle adjustment member 95. Specifically, the third engagement part 953 protrudes in a direction different from the respective directions in which the first and second engagement parts 951 and 952 protrude. The urging member 97 urges the third engagement part 953 so that the angle adjustment member 95 rotates in the rotation direction R6.

When the length of the contact part 93*b* protruding from the attachment plate 91 is decreased according to the worker operation of the operation member 921, the angle adjustment member 95 receiving urging force of the urging member 97 rotates in the rotation direction R6 following movement of the pressing member 93. The head assembly 1 accordingly rotates about the positioning member 8 (insertion hole 41) as the rotation center in the rotation direction R3 as described with reference to FIGS. 8 and 9.

Next, the operation member 921 will further be described with reference to FIG. 11. As illustrated in FIG. 11, the operation hole 921 is placed outside the second side wall 5*b*. This enables the worker to easily adjust the angle of the head assembly 1 installed in the installation base 5.

Next, the second angle adjustment mechanism 9 will further be described with reference to FIG. 12. FIG. 12 is a perspective view of the second angle adjustment mechanism 9 in the present embodiment. Specifically, FIG. 12 illustrates the second angle adjustment mechanism 9 as seen diagonally from above front left.

Figure 12:
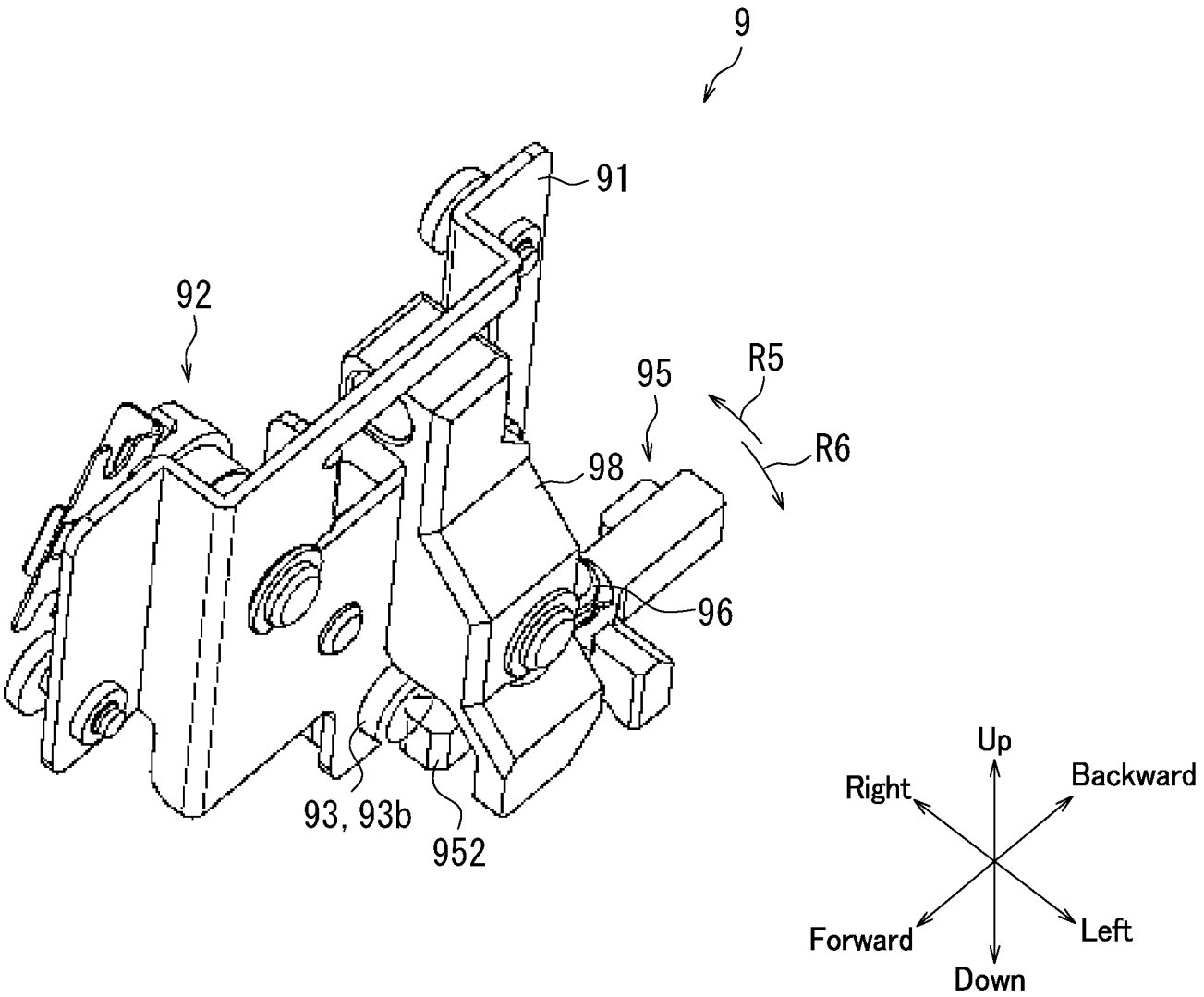
FIG. 12 is a perspective view of the second angle adjustment mechanism in the embodiment of the present disclosure.

As illustrated in FIG. 12, the second angle adjustment mechanism 9 further includes a regulation member 98. The regulation member 98 regulates rotation of the angle adjustment member 95. The regulation member 98 in the present embodiment regulates the rotation of the angle adjustment member 95 in the rotation direction R5. Specifically, the angle adjustment member 95 rotates in the rotation direction R5 according to an increase in the length of the contact part 93*b* protruding from the attachment plate 91 as described with reference to FIG. 11. The regulation member 98 therefore regulates the rotation of the angle adjustment member 95 according to the increase in the length of the contact part 93*b* protruding from the attachment plate 91.

The regulation member 98 regulating the rotation of the angle adjustment member 95 in the rotation direction R5 makes it difficult that the head assembly 1 collides with components constituting the installation base 5 during the angle adjustment of the head assembly 1. It is accordingly possible to reduce failure of the head assembly 1 due to the head assembly 1 colliding with the components constituting the installation unit 5. For example, the nozzle surface 31 of the recording head 3 is less likely to collide with the components constituting the installation unit 5. It is accordingly possible to reduce damage of the nozzle orifices due to the nozzle surface 31 of the recording head 3 colliding with the components constituting the installation unit 5.

Note that the rotation of the angle adjustment member 95 in the rotation direction R6 is regulated by the second side wall 5*b* or the attachment plate 91 as illustrated in FIG. 11. Specifically, the movement of the pressing member 93 is regulated by the second side wall 5*b*. Alternatively, the rotation of the second engagement part 952 is regulated by the attachment plate 91.

Figure 13:
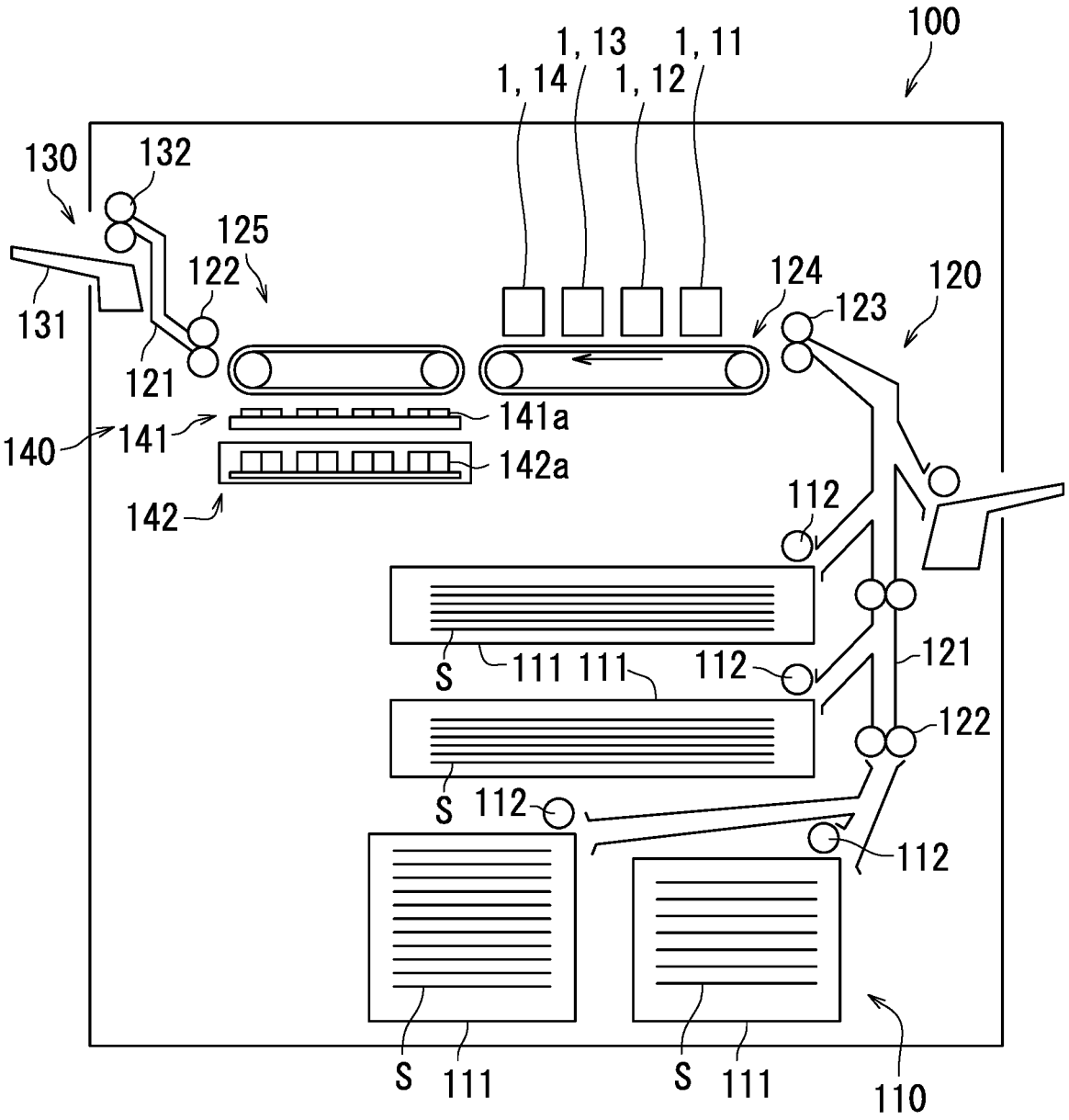
FIG. 13 illustrates the inkjet recording apparatus according to the embodiment of the present disclosure.

Next, the inkjet recording apparatus 100 according to the present embodiment will further be described with reference to FIG. 13. FIG. 13 illustrates a configuration of the inkjet recording apparatus 100 according to the present embodiment.

As illustrated in FIG. 13, the inkjet recording apparatus 100 includes a feeding section 110, a sheet conveyance section 120, an ejection section 130, and a maintenance unit 140. As stated above, the inkjet recording apparatus 100 includes the first head assembly 11, the second head assembly 12, the third head assembly 13, and the fourth head assembly 14.

The feeding section 110 feeds a sheet S to the sheet conveyance section 120. The feeding section 110 in the present embodiment includes housing cassettes 111 and feeding rollers 112. Each of the housing cassettes 111 houses therein at least one sheer S. Each of the feeding rollers 112 feeds a sheet S from a corresponding one of the housing cassettes 111 to the sheet conveyance section 120. Note that the sheet S is an example of a recording medium.

The sheet conveyance section 120 conveys a sheet S from each of the housing cassettes 111 to the ejection section 130. Specifically, the sheet conveyance section 120 includes conveyance guides 121, conveyance roller pairs 122, and a registration roller pair 123. The conveyance guides 121 constitute a conveyance path of the sheet S. The conveyance roller pairs 122 convey the sheet S along the conveyance path. The registration roller pair 123 adjusts conveyance timing of the sheet S to an area facing the first to fourth head assemblies 11 to 14.

The sheet conveyance section 120 in the present embodiment includes a first conveyance unit 124 and a second conveyance unit 125. The first conveyance unit 124 faces the first to fourth head assemblies 11 to 14. The first conveyance unit 124 conveys the sheet S in an area directly under the first to fourth head assemblies 11 to 14. The second conveyance unit 125 conveys the sheet S sent out from the first conveyance unit 124 toward the ejection section 130.

The three recording heads 3 provided for each of the first to fourth head assemblies 11 to 14 eject ink toward the sheet S being conveyed by the first conveyance unit 124. Specifically, the first to fourth head assemblies 11 to 14 eject ink of different colors. For example, the three recording heads 3 of the first head assembly 11 eject black ink. The three recording heads 3 of the second head assembly 12 eject cyan ink.

The three recording heads 3 of the third head assembly 13 eject magenta ink. The three recording heads 3 of the fourth head assembly 14 eject yellow ink.

The ejection section 130 ejects the sheet S to an outside of the inkjet recording apparatus 100. The ejection section 130 in the present embodiment includes an exit tray 131 and an ejection roller pair 132. The ejection roller pair 132 ejects the sheet S onto the exit tray 131.

The maintenance unit 140 performs maintenance of the three recording heads 3 for each of the first to fourth head assemblies 11 to 14. The maintenance unit 140 is placed below the second conveyance unit 125 when an image is recorded on the sheet S, and is moved to a location directly below the first to fourth head assemblies 11 to 14 during maintenance of the recording heads 3. Note that the first conveyance unit 124 is placed in a retraction position thereof during the maintenance of the recording heads 3. The retraction position is a position where the first conveyance unit 124 is prevented from colliding with the maintenance unit 140.

The maintenance unit 140 in the present embodiment includes a cap section 141 and a cleaning section 142. As described with reference to FIG. 3, each recording head 3 includes its own nozzle surface 31. The cap section 141 includes 12 capping members 141*a*. Each nozzle surface 31 of the three recording heads 3 for each head assembly 1 is capped with a corresponding one of the capping members 141*a* of the 12 capping members 141*a*. Thus, the 12 capping members 141*a* provide an environment where ink is less likely to dry.

The cleaning section 142 cleans the respective nozzle surfaces 31 of the recording heads 3. Specifically, the cleaning section 142 includes 12 wiper blades 142*a*. Material examples of each wiper blade 142*a* include resin. Each wiper blade 142*a* is a cleaning member for cleaning a corresponding one of the nozzle surfaces 31.

The cleaning section 142 moves the wiper blades 142*a* in the longitudinal direction of the recording heads 3 described with reference to FIG. 5 with the wiper blades 142*a* being in contact with respective lower surfaces of the recording heads 3. Thus, the nozzle surfaces 31 are cleaned as a result of the nozzle surfaces 31 being wiped off by the wiper blades 142*a*. Specifically, ink adhering to each nozzle surface 31 is wiped off by a corresponding one of the wiper blades 142*a*.

The embodiments of the present disclosure have been described above with reference to FIGS. 1 to 13. However, the present disclosure is not limited to the above embodiments and may be implemented in various manners within a scope not departing from the gist of the present disclosure. The components disclosed in the above embodiments can be changed as appropriate. The drawings schematically illustrate main elements of configuration to facilitate understanding thereof. Aspects of the elements of configuration illustrated in the drawings, such as thickness, length, number, and interval, may differ in practice for the sake of convenience for drawing preparation. Furthermore, aspects of the elements of configuration illustrated in the above embodiments are examples and are not particularly limited. The elements of configuration may be variously altered within a scope not substantially departing from the effects of the present disclosure.

Although the respective rotating shafts of the second and third recording heads 3*b* and 31 and the head assembly 1 are located on the same side (side of first end 1*a* of head assembly 1) as described with reference to FIG. 9, the present disclosure is not limited thereto. For example, the respective rotating shafts of the second and third recording heads 3*b* and 3*c* may be located at the side of the second end 1*b* of the head assembly 1.

Although neither rotating shaft member 61 nor first angle adjustment mechanism 6 is provided for the first recording head 3*a* in the embodiment of the present disclosure, the head assembly 1 may include a rotating shaft member 61 and a first angle adjustment mechanism 6 provided for the first recording head 3*a*.

Although the second angle adjustment mechanisms 9 are provided for the first to fourth head assemblies 11 to 14 as described with reference to FIGS. 8, and 10 to 12, the present disclosure is not limited thereto. For example, the inkjet recording apparatus 100 may have a configuration in which no second angle adjustment mechanism 9 is provided for the first head assembly 11.

Although the inkjet recording apparatus 100 includes the four head assemblies 1 as described with reference to FIG. 13, the number of head assemblies 1 provided for the inkjet recording apparatus 100 may be one, two, three, or five or more.

Although the head assembly 1 includes three recording heads 3 as described with reference to FIGS. 2 to 5, 8 and 9, the number of recording heads 3 provided for the head assembly 1 may be one, two, or four or more.

Although the coupling mechanism 92 includes the operation member 921 and the idler gear 922 as described with reference to FIGS. 10 and 11, the coupling mechanism 92 may include only the operation member 921. That is, the coupling mechanism 92 may have a configuration in which the tooth part of the operation member 921 (gear part 921*b*) engages with the tooth part of the pressing member 93 (gear part 93*a*). Alternatively, the coupling mechanism 92 may include idler gears 922.

What is claimed is:

1. A head assembly, comprising:

a base member;

recording heads each of which is configured to eject ink;

coupling members that couple the recording heads to the base member;

at least one first rotating shaft member that serves as a rotating shaft of at least one recording head of the recording heads; and at least one first angle adjustment mechanism configured to rotate the at least one recording head about the at least one first rotating shaft member as a rotation center, wherein each of the recording heads includes a first end and a second end on an opposite side from the first end, the coupling members include:

first coupling members that couple respective first ends of the recording heads to the base member; and second coupling members that couple respective second ends of the recording heads to the base member, the at least one first rotating shaft member is provided for, of the first coupling members, at least one first coupling member corresponding to the at least one recording head, and the at least one first angle adjustment mechanism is provided for, of the second coupling members, at least one second coupling member corresponding to the at least one recording head.

2. The head assembly according to claim 1, wherein the at least one first angle adjustment mechanism includes a pressing member that is in contact with the second end of the at least one recording head and configured to rotate the at least one recording head in a first rotation direction; and an urging member configured to urge the second end of the at least one recording head in a second rotation direction opposite to the first rotation direction.

3. The head assembly according to claim 1, comprising a first end and a second end on an opposite side from the first end, wherein the recording heads are positioned such that the respective first ends of the recording heads are closer to the first end of the head assembly than the respective second ends of the recording heads.

4. An inkjet recording apparatus, comprising:

the head assembly according to claim 1; and an installation base in which the head assembly is installed.

5. The inkjet recording apparatus according to claim 4, comprising:

a second rotating shaft member that is provided for the installation base and functions as a rotating shaft of the head assembly; and a second angle adjustment mechanism that is provided for the installation base and configured to rotate the head assembly about the second rotating shaft member as a rotation center.

6. The inkjet recording apparatus according to claim 5, wherein:

the head assembly includes a first end and a second end on an opposite side from the first end;

the second rotating shaft is located at a side of the first end of the head assembly; and the second angle adjustment mechanism is located at a side of the second end of the head assembly.

7. The inkjet recording apparatus according to claim 5, wherein the second angle adjustment mechanism includes:

a third rotating shaft member; and an angle adjustment member that is rotatable about the third rotating shaft member as a rotation center, the angle adjustment member includes a first engagement part that engages with the head assembly, the head assembly includes a head engagement part that engages with the first engagement part, the angle adjustment member is configured to cause the first engagement part to push the head engagement part according to rotation of the angle adjustment member about the third rotating shaft member as the rotation center in a first rotation direction, and the head assembly is configured to rotate about the second rotating shaft as a rotation center according to the first engagement part pushing the head engagement part.

8. The inkjet recording apparatus according to claim 7, wherein the second angle adjustment mechanism includes a pressing member that engages with the angle adjustment member, the angle adjustment member includes a second engagement part that engages with the pressing member of the second angle adjustment mechanism, and the second angle adjustment mechanism is configured to cause the angle adjustment member to rotate in the first rotation direction according to the pressing member of the second angle adjustment mechanism pushing the second engagement part.

9. The inkjet recording apparatus according to claim 8, wherein the second angle adjustment mechanism includes a coupling mechanism that is coupled to the pressing member of the second angle adjustment mechanism, and the coupling mechanism is configured to move the pressing member of the second angle adjustment mechanism so that the pressing member of the second angle adjustment mechanism pushes the second engagement part.

10. The inkjet recording apparatus according to claim 9, wherein the coupling mechanism includes an operation member that allows a worker to operate, and the coupling mechanism is configured to move the pressing member of the second angle adjustment mechanism according to operation of the operation member by the worker.

11. The inkjet recording apparatus according to claim 10, wherein the installation base includes a side wall;

the angle adjustment member is placed inside the side wall; and the operation member is placed outside the side wall.

12. The inkjet recording apparatus according to claim 7, wherein the second angle adjustment mechanism includes an urging member that urges the angle adjustment member such that the angle adjustment member is rotated in a second rotation direction, and the second rotation direction is a rotation direction opposite to the first rotation direction.

13. The inkjet recording apparatus according to claim 7, wherein the second angle adjustment mechanism includes a regulation member that regulates rotation of the angle adjustment member.

* * * * *